US006959774B2

(12) United States Patent
Nackerud

(10) Patent No.: US 6,959,774 B2
(45) Date of Patent: Nov. 1, 2005

(54) DRILLING APPARATUS

(76) Inventor: Alan L. Nackerud, 6801 N. Peterson Rd., Sedalia, CO (US) 80135

( * ) Notice: Subject to any disclaimer, the term of this patent is extended or adjusted under 35 U.S.C. 154(b) by 48 days.

(21) Appl. No.: 10/428,495

(22) Filed: May 2, 2003

(65) Prior Publication Data

US 2003/0192719 A1 Oct. 16, 2003

Related U.S. Application Data

(63) Continuation-in-part of application No. 09/962,363, filed on Sep. 25, 2001, now Pat. No. 6,695,074, and a continuation-in-part of application No. 09/699,172, filed on Oct. 27, 2000, now Pat. No. 6,454,024.

(51) Int. Cl.[7] ..... E21B 10/66; E21B 7/28

(52) U.S. Cl. ..... 175/267; 175/406; 175/424

(58) Field of Search ..... 175/257, 258, 175/263, 265, 267, 292, 406, 424; 166/257, 258, 263, 265, 267, 292, 406, 424

(56) References Cited

U.S. PATENT DOCUMENTS

| | | | | |
|---|---|---|---|---|
| 2,203,998 A | | 6/1940 | O'Grady | |
| 2,814,463 A | | 11/1957 | Kammerer, Jr. | |
| 3,196,961 A | | 7/1965 | Kammerer | |
| 3,552,509 A | | 1/1971 | Brown | |
| 3,554,304 A | | 1/1971 | Link et al. | |
| 3,656,564 A | | 4/1972 | Brown | |
| 3,684,041 A | | 8/1972 | Kammerer, Jr. | |
| 4,565,252 A | * | 1/1986 | Campbell et al. | 175/269 |
| 5,271,472 A | | 12/1993 | Leturno | |
| 5,385,205 A | * | 1/1995 | Hailey | 166/55.8 |
| 5,494,121 A | | 2/1996 | Nackerud | |
| 6,454,024 B1 | * | 9/2002 | Nackerud | 175/57 |
| 6,691,803 B2 | * | 2/2004 | Nackerud | 175/57 |
| 6,695,074 B2 | * | 2/2004 | Nackerud | 175/57 |
| 2002/0050409 A1 | * | 5/2002 | Nackerud | 175/67 |

* cited by examiner

*Primary Examiner*—William Neuder
(74) *Attorney, Agent, or Firm*—John E. Reilly

(57) ABSTRACT

A drilling apparatus for earth boring operations is of the type having cutter blades mounted on a support body at the lower end of a drill string and includes a novel arrangement of fluid bore sections for delivering fluid under pressure into fluid discharge passages in each of the blades and a bifurcated pivotal mounting portion on the body which enables the bore sections to supply fluid to the cutter blades through a ball joint on the pivotal axis. Modified forms of invention are specifically designed for cutter blades which are intended to perform reaming operations but include the fluid delivery system as well as an extended delivery system for delivering fluid under pressure to other tools in the drill string.

24 Claims, 4 Drawing Sheets

DRILLING APPARATUS

CROSS-REFERENCE TO RELATED APPLICATIONS

This application is a continuation-in-part of patent applications Ser. No. 09/962,363 for METHOD AND APPARATUS FOR ENLARGING WELL BORES, filed 25 Sep. 2001 now U.S. Pat. No. 6,695,074 and Ser. No. 09/962,365 for DRILL BIT ASSEMBLY HAVING PIVOTAL CUTTER BLADES, filed 25 Sep. 2001, respectively, by Alan L. Nackerud, both of which are incorporated by reference herein, said aforesaid applications both being continuations-in-part of U.S. Pat. No. 6,454,024 for REPLACEABLE DRILL BIT ASSEMBLY, also incorporated by reference herein.

BACKGROUND AND FIELD OF INVENTION

This invention relates to drilling apparatus, and more particularly relates to a novel and improved drilling apparatus with fluid delivery bores for directing fluids from a drill string into drill bits, reaming tools and the like. The invention is adaptable for use with liquids and gaseous materials but is particularly useful in connection with liquids to be used in subsurface formations.

I have previously devised drill bit assemblies as well as reaming devices which are broadly characterized by having a rotary drill bit mounted at the lower end of a conventional drill string and cutter blades pivotally mounted on the drill bit. In high speed earth boring operations to be carried out with fluid assist, the cutter blades are equipped with fluid discharge nozzles which communicate with fluid delivery hoses extending downwardly through the drill string into direct connection with the fluid discharge passages in each of the cutter blades. Although the hoses prevent leakage between the drill string and blades, they are quite bulky, are subject to wear or blow out under repeated use and impose limitations on the ability to mount the cutter blades for free pivotal movement from a vertical to horizontal position at the end of the drill string. Accordingly, there is a need for a fluid delivery system which eliminates the need for fluid delivery hoses and can achieve direct delivery of fluid through bores formed out of the thickness of the blade support body. Still further, and in association with the improved fluid delivery system, is to provide for a novel and improved ball joint between the blade support body and cutter blades which does not interfere with fluid delivery and results in an improved installation, operation, versatility and reliability in use of the blades in downhole operations.

Representative patents are U.S. Pat. No. 2,203,998 to D. J. O'Grady, U.S. Pat. No. 2,814,463 to A. W. Kammerer, Jr., U.S. Pat. No. 3,196,961 to A. W. Kammerer, U.S. Pat. No. 3,552,509 to C. C. Brown, U.S. Pat. No. 3,554,304 to H. D. Link et al, U.S. Pat. No. 3,656,564 to C. C. Brown, U.S. Pat. No. 3,684,041 to A. W. Kammerer et al, U.S. Pat. No. 5,271,472 to R. E. Leturno, U.S. Pat. No. 5,385,205 to C. D. Hailey and U.S. Pat. No. 5,494,121 to A. L. Nackerud.

SUMMARY OF THE INVENTION

It is an object of this invention to provide for a novel and improved drilling apparatus for earth boring operations which is highly versatile and efficient and durable in use.

Another object of the present invention is to provide for a novel and improved blade support body adapted to be mounted on a conventional drill string for pivotally supporting cutter blades and delivering fluid under pressure through discharge nozzles positioned along the length of one or more of the cutter blades in achieving a uniform cutting force along the length of each blade.

A further object of the present invention is to provide for a novel and improved drill support body containing fluid delivery passages together with a novel and improved joint for supporting one or more cutter blades in order to carry out downhole cutting and kerfing operations.

It is a still further object of the present invention to provide for a novel and improved blade support body containing fluid delivery bores therein for delivering fluid under pressure through fluid passages in the cutter blades to maximize cutting performance and speed; and further therein for delivering fluid under pressure through fluid passages in the cutter blades to maximize cutting performance and speed; and further wherein the tool support body includes a novel and improved ball joint for mounting of the pivotal cutter blades in direct communication with the fluid delivery bores while being freely pivotal about the blade support body.

It is a still further object to provide for a blade support body which is conformable in performing various earth boring operations including but not limited to vertical or horizontal directional drilling, reaming and underreaming, for example, in forming enlarged cavities or caverns in a subsurface formation as well as for kerfing operations.

It is an additional object of the present invention to provide for a blade support body which is rugged, durable and extremely versatile for use either at the terminal end of a drill string or at one or more intermediate sections for pivotal cutter blades with fluid assist.

In accordance with the present invention, a novel and improved fluid delivery system has been devised for use in drilling apparatus for earth boring operations in which a drill string is provided with a source of fluid under pressure, the improvement comprising at least one cutter blade having a plurality of fluid discharge passages therein, a blade support body connected to the drill string and provided with at least one fluid delivery bore in communication with a fluid delivery passage in the drill string, and pivotal mounting means for pivotally connecting one end of the cutter blade to the blade support body whereby to establish communication between the fluid bore(s) in the body and the fluid discharge passages in the blade(s). Preferably, the fluid delivery system consists entirely of fluid bores drilled out of the thickness of the blade support body as well as the cutter blade in order to obviate the use of flexible hoses; also, the provide a novel and improved ball joint at the pivotal axis for the cutter blade(s) in which the bore sections extend through the ball joint and the cutter blade(s) is free to pivot without interrupting the flow of fluid from the blade support body into the blade(s) when they are advanced into the cutting position. Although the preferred form is specifically adapted for use with drill bits, alternate preferred forms have been devised for use with reaming tools characterized by having pilot noses to guide the advancement of the reaming tools into the formation. In addition, one of the alternate preferred forms includes a plurality of blade support bodies connected in end-to-end relation to one another with bore sections in communication with one another between the bodies and, for example, which may be utilized in conducting combined drilling and reaming operations.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENT

Figure 1:
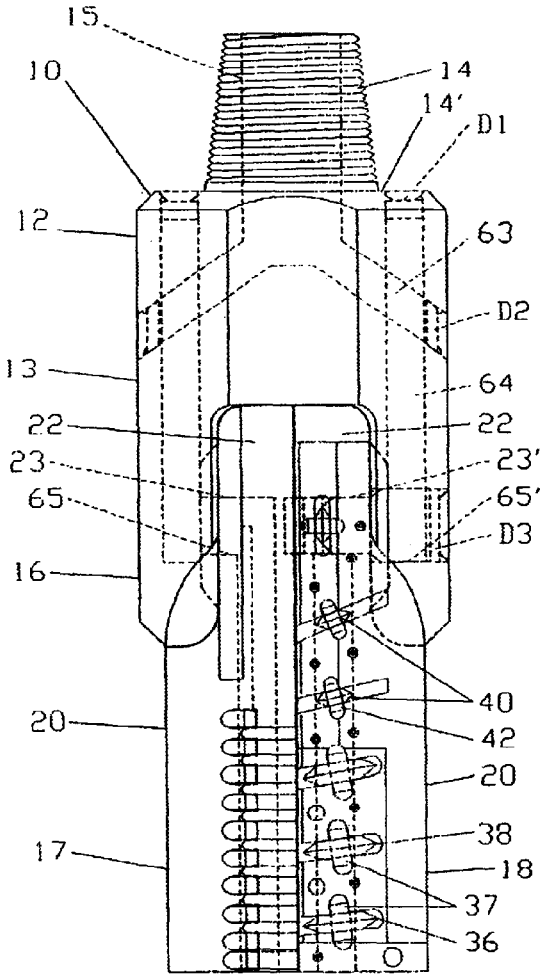
FIG. 1 is a front elevational view of a preferred form of blade support body for a drill bit with the blades shown at rest.
Figure 2:
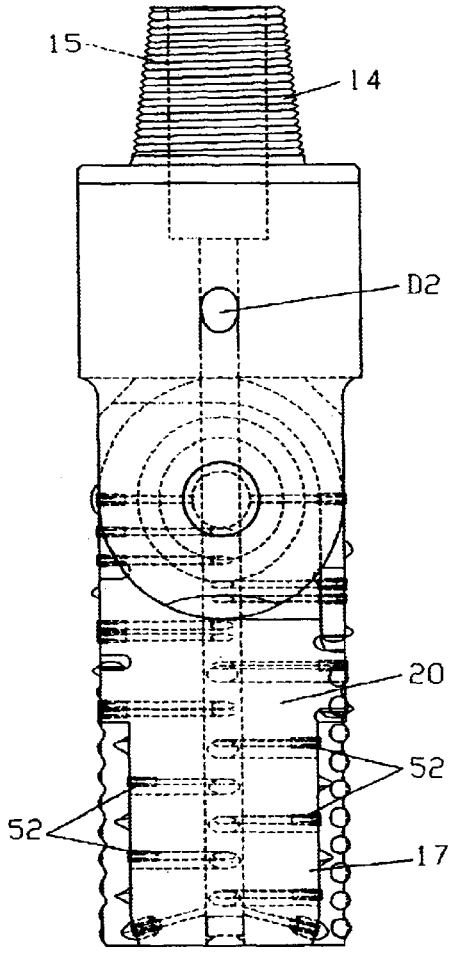
FIG. 2 is a side elevational view of the preferred form of invention shown in FIG. 1.
Figure 1A:
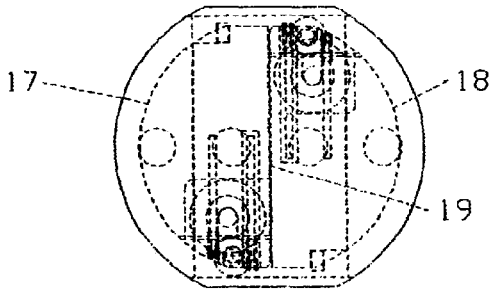
FIG. 1A is a bottom plan view of the apparatus shown in FIG. 1.
Figure 3:
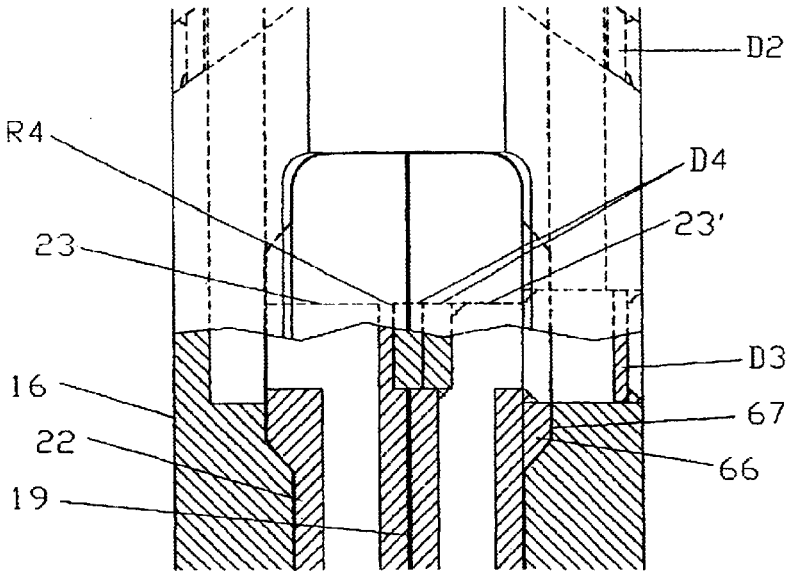
FIG. 3 is an enlarged view partially in section of the joint portion of the blade support body.
Figure 4:
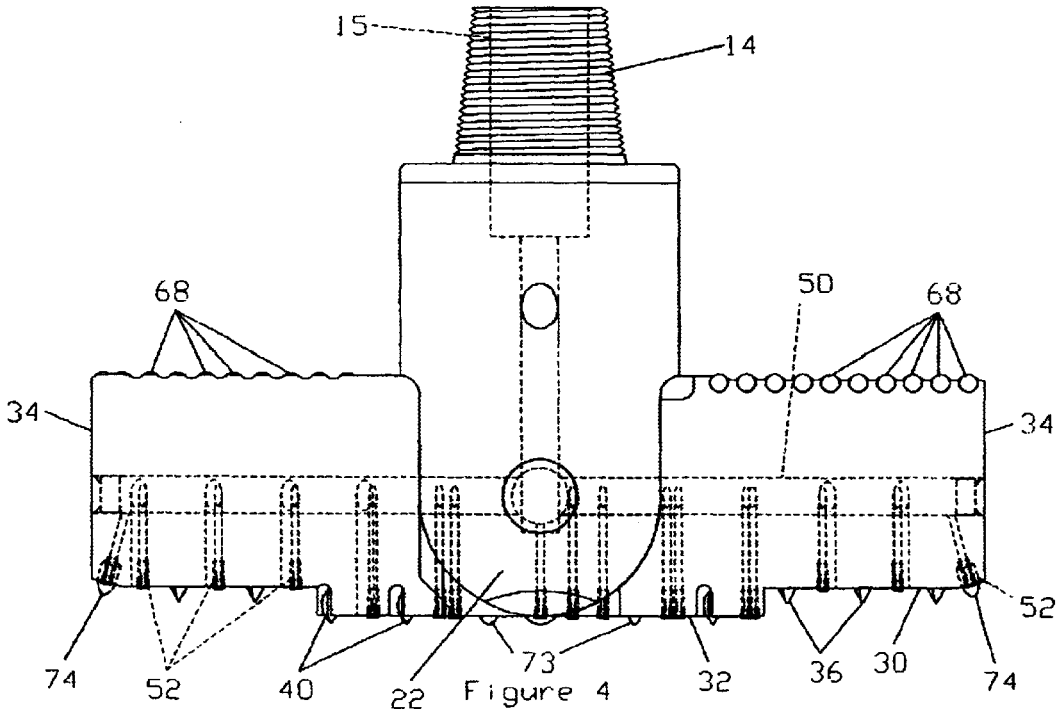
FIG. 4 is an elevational view of the blade support body shown in FIG. 1 with the cutter blades in the cutting position.

Referring in more detail to the drawings, there is shown by way of illustrative example in FIGS. 1 to 4 a drill bit assembly 10 which is comprised of a sub 12 in the form of a hollow cylindrical blade support body 13 having an upper threaded end 14 and a lower bifurcated pivotal end 16. A pair of cutter blades 17 and 18 are each made up of an elongated blade arm 20 tapering into a rounded pivotal end 22 having a transverse bore 23, 23' for pivotal connection to the lower pivotal ends 16 of the blade support body 13. Each blade arm 20 is of generally semi-circular configuration having flat, confronting surface portions 19. Thus the blades 17 and 18 are supported for pivotal movement between a first position extending substantially in a lengthwise direction when at rest and a transverse or mutually perpendicular direction when in operation as illustrated in FIGS. 1 and 4, respectively. The pivotal ends 16 are in the form of ears or extensions of the hollow cylindrical body 13 so as to be arcuate in cross-section.

Each of the blades 17 and 18 has a generally concave surface portion tapering into the pivotal end 22, and the pivotal ends 22 are of a thickness such that when mounted on the pivot shaft 24 will clear the pivotal end 16 so that the blade arms are free to swing freely into and away from the mutual perpendicular positions shown in FIG. 4.

Each of the blade arms 20 includes radially offset larger and smaller semi-circular body portions 30 and 32, the larger portion 32 extending along the inner radial surface of the arm 20 adjacent to the pivotal end 22. The smaller portion 30 is of approximately the same length as the larger portion 32 and terminates in an outer squared distal end 34 of the arm. In the smaller surface portion 30, a series of first cutter disks 36 are mounted for rotation about individual roller shafts 37 which are fixed in recesses in the undersurface of each of the blade arms 20 and at uniform, axially spaced intervals along the undersurface of each arm adjacent to the flat surfaces 19. As best seen from FIG. 1, the axis of rotation for each disk is such as to correspond to the radius of curvature which that disk follows. In other words, the shaft 37 for that disk is perpendicular to the radius of curvature at that point on the undersurface of the arm 20. The individual disks 36 are of a hardened material, such as, tungsten carbide material and have tapered surfaces which terminate in a common cutting edge 38.

The radially inner body portion 32 is provided with relatively small cutter disks 40 which are mounted for rotation about individual shafts 42. The disks 40 are oriented in a manner corresponding to that described with reference to the larger disks 36 so as to follow the circular path of rotation at that radius from the center or pivotal axis 24. The disks 40 are similarly arranged to extend along the undersurface or leading edge of the blade arm but in slightly trailing relation to the larger disks 36.

As shown in FIGS. 1 to 4, each blade arm 20 includes a main fluid delivery passage 50 extending radially of the arm and communicating with a plurality of discharge nozzles or jets 52 which discharge fluid under pressure from the blade arms at a location in close proximity to the cutter disks 40.

In order to supply water under pressure to the blade arms 17 and 18, the upper threaded end 14 of the sub 12 has a main bore 15 which communicates with diametrically opposed angular bores 63 extending downwardly and radially outwardly through the wall thickness of the cylindrical body 13 into communication with diametrically opposed, axially extending bores 64. In the preferred form, the bores 64 are drilled out of the thickness of the body 13 starting at the upper shoulder 14' and terminating at their lower ends in transverse bores 65 and 65' in the lower pivotal ends 16. The bores 65 and 65' extend transversely through annular ball joints to be described and into direct communication with the openings or bores 23 and 23' in the blade arms 17 and 18.

The bores 63, 64 and 65, 65' are preferably drilled into the wall thickness of the body 13, and the ends of the bores 63, 64 and 65 are plugged by suitable disks as designated at $D_1$, $D_2$ and $D_3$. A pair of disks $D_4$ are stacked in the innermost end of the bore 23' of one of the blade arms, and the innermost disk $D_4$ projects into a recess $R_4$ in the confronting surface of the opposite blade arm 17 so as to cooperate with the ball joints hereinafter described in pivotally mounting the blade arms on a common axis extending centrally through the bores 23, 23' and 65, 65'.

The ball joints serve as the principal means of pivotal support for the blade arms and are made up of annular or ring-like projections 66 of semi-spherical cross-sectional configuration which are journaled in shallow recesses 67 in each of the respective pivotal ends 16. Again, the bores 65 and 65' extend centrally through the ball joints and are aligned with the bores 23 and 23', respectively, to direct the fluid flow into the passages 50 in the blade arms 17 and 18 while maintaining a tight seal between the blade arms 17 and 18 and the pivotal ends 16.

A series of cutting inserts 68 of a hardened cutting material are inserted in circular recesses along the trailing edge of each blade 17 and 18. Each insert 68 is of generally elongated cylindrical configuration having a tapered end 70 which protrudes from the trailing edge in order to cut into the formation when the blades 17 and 18 are rotated. The cutting inserts 68 are most useful in the event of formation hole collapse, hole sloughing or hole swelling. Under continued rotation and/or frictional force engagement and/or fluid discharge force, the blades 17 and 18 will gradually swing or pivot outwardly into their mutually perpendicular position as shown in FIG. 4. At that point, the cutter disks 36 and 40 will gradually move into cutting engagement with the formation. Along with the cutting inserts 26 on the bifurcated end surfaces 16 of the sub 12, cutting inserts 73 may be positioned along at least a limited portion of the leading edge of each inner blade portion 32, and cutting inserts 74 are positioned at outer distal ends of the blades 17 and 18.

The cutter disks 36 and 40 on one blade arm 17 are offset with respect to the cutter disks 36 and 40 on the other blade arm 18. Correspondingly, the nozzles 52 on the one blade arm 17 are offset or staggered with respect to the nozzles 52 on the other blade arm 18. The primary function of the nozzles is to form kerf lines and the cutter disks 36 and 40 are operative to break up the rock between the kerf lines and therefore are aligned between the nozzles 52 of their respective blade arms.

In operation, the drill bit assembly 10 is assembled by threading the end 14 into the lower end of a conventional drill, casing or tubing string. The drill bit assembly is then rotated as it is lowered into position at the desired location for earth boring into the formation so as to cause the blades 17 and 18 to swing outwardly into the open position shown in FIG. 1. Fluid is supplied under pressure through the bores 63, 64, 65 and 65' as described into the bores 23 and 23' in the blade arms 17 and 18 and is discharged in the form of high velocity jet streams through the nozzles 52. The delivery of fluid under a high degree of force through the blades 17 and 18 will assist in causing the blades to gradually swing outwardly into the cutting position shown in FIG. 1 as well as to cooperate with the cutter disks 36 and 40 in cutting through the formation in forming the desired size bore or hole. The fluid which is pumped through the nozzles or jets will further assist in removing the cuttings upwardly between the drill string and face of the bore to the surface.

The smaller sized disks 40 are employed along the larger surface portion 32 at the inner radial end of the arm 20 as a result of space limitations on the size of disks that can be employed adjacent to the lower pivotal end 16. The function of the larger disk 36 is to provide an increased cutting surface area in traversing greater distances at the outer distal ends of the blades 17 and 18. It will be apparent that the fluid bores 63, 64, 65 and 65' may be formed without necessarily drilling through the external surfaces of the body 13. The larger cutting disks 36 employed along the smaller surface portion 30 may be varied in size, and it is not particularly critical whether the large disks 36 are in trailing relation to the smaller disks 40 and is more a matter of dimensioning the disks 36 and 40 to best fit into the body portions 30 and 32 and leave adequate space for the fluid delivery passages.

DETAILED DESCRIPTION OF MODIFIED FORMS OF INVENTION

Figure 7:
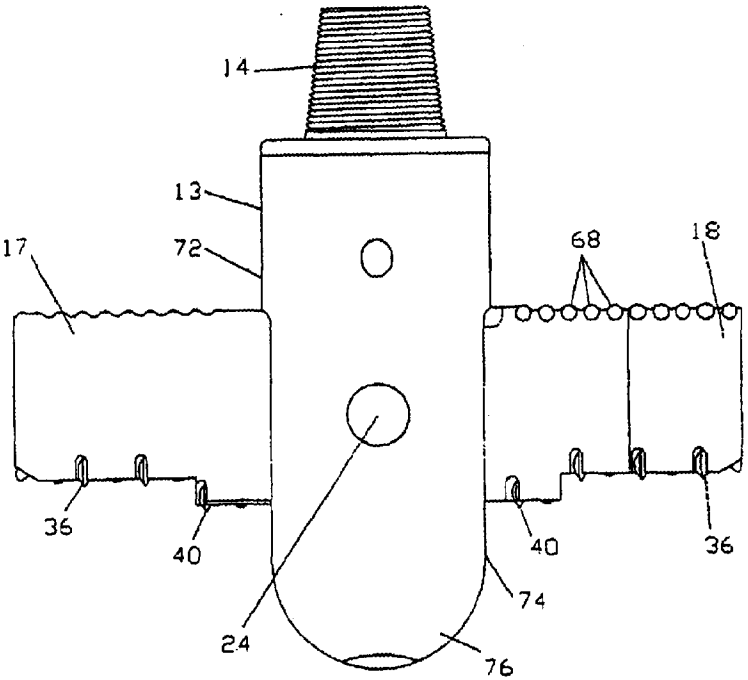
FIG. 7 is another side elevational view of the tool shown in FIG. 6 with the cutter blade shown in the cutting position.
Figure 6:
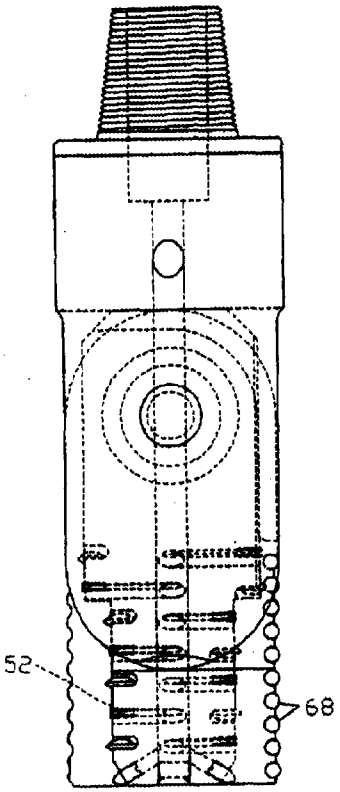
FIG. 6 is a side elevational view of the tool shown in FIG. 5 with the cutter blades shown at rest.
Figure 5:
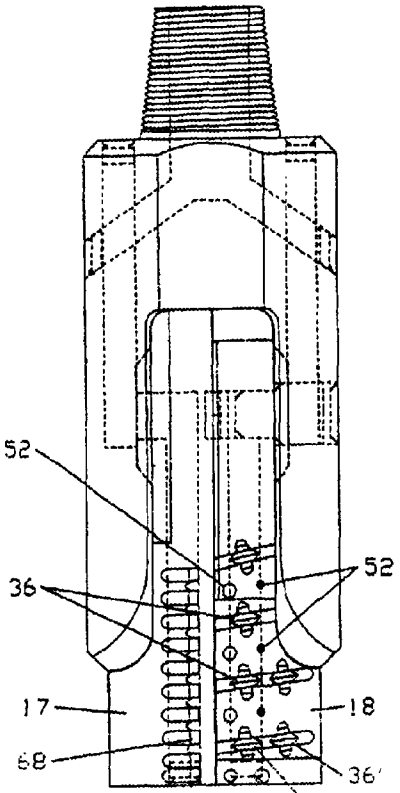
FIG. 5 is a front elevational view of a modified form of blade support body having a short pilot nose for underreaming operations.

A modified form of invention is illustrated in FIGS. 5 to 7 in which like parts to those of FIGS. 1 to 4 are correspondingly enumerated. The principal distinction in the form of FIGS. 5 to 7 is the construction of the sub 72 in place of the sub 12 with an upper threaded end 14 and body 13 which merges into a lower pivotal end 74 and terminates in a rounded leading end or nose 76 at its lower extremity. The blades 17 and 18 correspond to the blades 17 and 18 of the preferred form but are provided with additional cutter disks 40' in circumferentially spaced relation to the cutter disks 36. Further, as in the preferred form, the nozzles 52 are spaced between the cutter disks 36 and 40 along the length of the blade 18. As such, the tool with sub 72 is designed and constructed for use as a reaming tool in which the elongated lower end 74 with nose 76 will serve as a guide in an existing well bore to center the tool for reaming operations, for example, in underreaming well bores and caverns particularly in hard rock subsurface formations. Thus, the fluid delivery system characterized by the bore sections 63, 64, 65 and 65' into the fluid passages 50 of the blades 17 and 18 will cooperate in forcing the blades into a mutually perpendicular cutting position.

In practice, the upper threaded end 14 of the sub 72 is connected to the lower end of a drill string or other rotational drive means, not shown. The reaming tool is then lowered beyond the cased portion of the earth bore so that under rotational force applied to the drill string the blades 17 and 18 will gradually expand outwardly as the cutter inserts 68 initially cut into the surrounding formation and advance into a position substantially perpendicular to the drill pipe as shown in FIG. 7. Outward expansion of the blades 17 and 18 is further assisted by application of fluid under pressure through the drill string and main bore 15 of the tool then pumped through the bore sections 63, 64, 65 and 65' until it is discharged in the form of high velocity jet streams via the nozzles 52. The fluid which is pumped through the nozzles 52 will assist in removing any cuttings and, under continued downward advancement, the leading end or nose 76 will guide the tool through the existing bore and discourage any tendency of the tool to alter its course away from the existing bore. The cutter disks 36 and 40 will cooperate also with the cutting insert 68 in cutting through the formation to substantially enlarge the diameter of the well bore.

Figure 8:
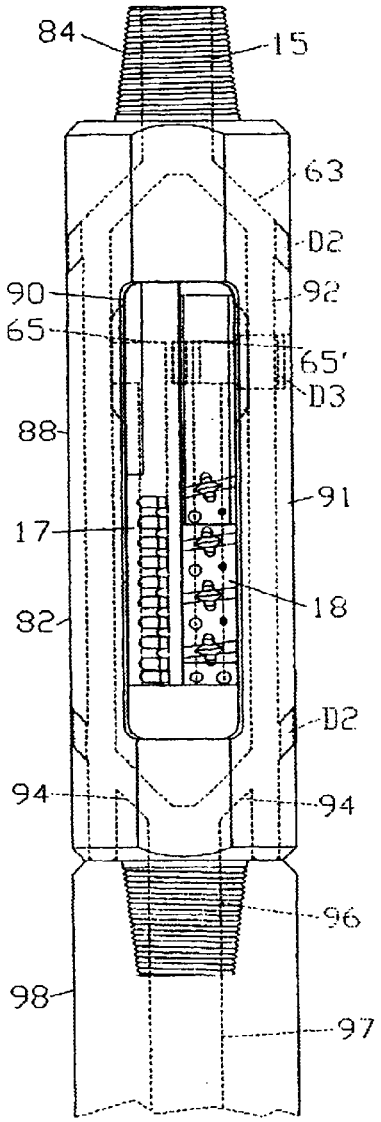
FIG. 8 is a front elevational view of another modified form of reaming tool with long pilot nose and threaded connections at both ends and fluid delivery bores which mate with fluid delivery bores in the drill string or other tools at opposite ends of the blade support body.
Figure 9:
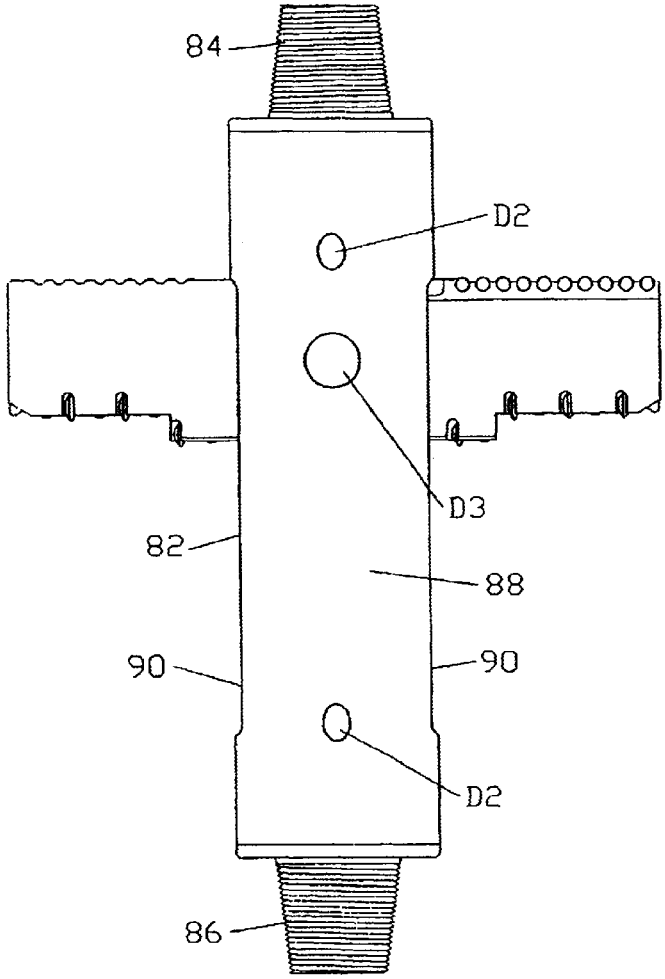
FIG. 9 is a side elevational view of the tool support body shown in FIG. 8 with the blades shown in the cutting position.

Another modified form of reaming tool is illustrated in FIGS. 8 and 9 and wherein again like parts are correspondingly enumerated to those of FIGS. 1 to 4. An elongated sub 82 has opposite threaded ends 84 and 86 and an elongated hollow cylindrical body 88 therebetween with diametrically opposed slots 90 communicating with the hollow interior of the body 88. The slots are sized to accommodate cutter blades 17 and 18 between the mutually opposed, bifurcated pivotal mounting portions 91 of the body 88. The bifurcated portions 91 are located in an intermediate portion of the body 88 and are of a length sufficient for the blades to be free to pivot outwardly from an axially extending position within the body 88, as shown in FIG. 8, and a cutting position as shown in FIG. 9.

Water under pressure is supplied to the blade arms 17 and 18 through the bore 15 in the upper threaded end 84, angular bore sections 63 extending through the wall thickness of the body into communication with diametrically opposed longitudinally extending bore sections 92 which intersect transverse bores 65 and 65' in the intermediate portion of the body 88 and oriented on a common pivotal axis extending transversely through the upper ends of the blade arms 17 and 18 and the mounting portions 91. The bore sections 92 continue downwardly beyond the bores 65 and 65' for the remaining length of the body 88 and intersect lower angled bores 94 which extend upwardly from lower main bore 96 in the lower threaded portion 86. The lower main bore 96 communicates with another bore section 97 in a connecting sub or tool represented at 98 and which is threaded onto the lower end of the sub 82. As in the preferred form, the bore sections 63, 92, 94, 65 and 65' are drilled into the wall thickness of the body 88 from an external surface and are closed off by suitable disks $D_2$ and $D_3$.

In use, the drill string with tool 82 is lowered beyond a cased portion of an earth bore and, under rotational force together with the application of fluid under pressure through the bore sections into the fluid discharge passages in the blades 17 and 18, will cause the blades to cut into the surrounding formation and expand outwardly to substantially enlarge the uncased portion of the well bore. The additional length of the sub 82 will act as a pilot or guide in maintaining the tool in centered relation. Also, additional fluid may be supplied through the lower bore sections of the bore 92 and angled bore 94 into the next sub or tool represented at 98. For example, the member 98 may be a plug with rounded end or may be a drill assembly with fluid assist as in FIGS. 1 to 4. Accordingly, once past the drill casing it would be possible to simultaneously drill and underream the hole, such as, in directional drilling operations.

It will be appreciated that the blades 17 and 18 for the preferred and modified forms of invention may be designed of different lengths according to the degree of enlargement of the open hole that is required, particularly with regard to the reaming tools shown in the modified forms.

It will be evident that seals may be employed, for example, along the interfaces between the blades 17 and 18 and the lower pivotal ends of the sub 12 or the pivotal mounting portions 91 of the sub 82.

It is therefore to be understood that while a preferred form of invention is herein set forth and described the above and other modifications and changes may be made therein without departing from the spirit and scope of the invention as defined by the appended claims and reasonable equivalents thereof.

I claim:

1. In drilling apparatus for earth boring operations wherein a drill string is provided with a source of fluid under pressure and rotary drive means, the improvement comprising:

at least one cutter blade having a plurality of fluid discharge passages therein;

a blade support body connected to said drill string provided with at least one fluid delivery bore in communication with a fluid delivery passage in said drill string; and means including a rotatable joint for pivotally connecting one end of said cutter blade(s) to said body whereby to establish communication between said fluid bore(s) in said body and said fluid discharge passages in said blade(s) and wherein each said cutter blade is extendable from said body into a cutting position substantially perpendicular to the length of said drill string in response to rotation of said drill string and delivery of fluid through said fluid discharge passages in said cutter blade(s).

2. In a drilling apparatus according to claim 1 wherein a pair of said cutter blades are pivotal between an axially extending position at rest and a cutting position substantially perpendicular to the length of said drill string.

3. In a drilling apparatus according to claim 1 wherein each said fluid delivery bore includes an axially extending main bore section, an axially extending outer bore section radially offset from said main bore section, an angular bore section extending between said main bore section and said outer bore section, and a radially extending bore in communication with said fluid delivery passages.

4. In a drilling apparatus according to claim 3 wherein said outer bore section extends the substantial length of said blade support body.

5. In a drilling apparatus according to claim 4 wherein a plurality of blade support bodies are connected in end-to-end relation to one another and having respective of said outer bore sections in communications with one another.

6. In a drilling apparatus according to claim 3 wherein said bore sections are straight and include plug members closing one end of each of said bore sections.

7. In a drilling apparatus according to claim 6 wherein said bore sections extend through an external surface of said blade support body.

8. In a drilling apparatus according to claim 1 wherein said body is of hollow generally cylindrical configuration and includes bifurcated mounting portions, and a pair of said cutter blades are pivotally connected between said bifurcated mounting portions.

9. In a drilling apparatus according to claim 8 wherein said joints are ball joints in opposed facing relation to one another and said radially extending bores extend through said ball joints.

10. In a drilling apparatus according to claim 9 wherein each of said cutter blades includes a fluid bore section extending radially between said fluid discharge passages and said radially extending bores.

11. In a drill bit assembly adapted to be mounted on a drill string for earth boring operations wherein a sub is connected to a lower end of said drill string, a pair of elongated cutter blades are pivotally secured to a lower end of said sub, said lover end being bifurcated and including cutting elements thereon, each of said blades being of generally semi-circular cross-sectional configuration and having flat surface portions in confronting relation to one another, the improvement comprising;

ball joints interposed between said cutter blades and said lower end for pivotal movement of said cutter blades between a common axial direction and opposite perpendicular directions to one another; and fluid delivery means consisting entirely of fluid delivery bores extending between said drill string and fluid delivery passages in each of said cutter blades.

12. In a drill bit assembly according to claim 11 wherein a disk is interpositioned between confronting surfaces of said cutter blades on a pivotal axis extending through said cutter blades for independent pivotal movement of said cutter blades with respect to one another.

13. In a drill bit assembly according to claim 11 wherein said fluid delivery passages include a plurality of fluid discharge nozzles along leading edges of said cutter blades, and cutting elements disposed between said fluid discharge nozzles.

14. In a drill bit assembly according to claim 13 wherein said cutting elements are of increased diameter in an outward radial direction along each of said blades.

15. In a drill bit assembly according to claim 11 wherein each of said blades includes a plurality of radially spaced cutting elements along leading and trailing edges thereof.

16. In a drill bit assembly according to claim 15 wherein a pair of said fluid discharge nozzles are mounted in fore and aft relation to one another.

17. In a tool for enlarging an earth bore in a subsurface formation wherein rotational drive means is lowered through the earth bore to a point at which it is desired to enlarge the bore, the improvement comprising:

a plurality of elongated cutter blades, each of said blades having a plurality of fluid discharge passages therein;

a blade support body connected to said drive means and provided with at least one fluid delivery bore communicating with a fluid delivery passage in said drive means; and pivotal mounting means for pivotally connecting said cutter blades to said body whereby to establish communication between said fluid bore in said body and said fluid discharge passage in said blade and wherein said pivotal mounting means includes a first pivot member between said blades and second pivot members between said blades and said body, said first and second pivot members blades disposed on a common pivotal axis.

18. In a tool according to claim 17 wherein said second pivot members are defined by ball joints.

19. In a toot according to claim 18 wherein said fluid bore in said body extends through one of said ball joints into communication with said fluid discharge passage.

20. In a tool according to claim 17 wherein said body is of hollow generally cylindrical configuration and terminates in lower bifurcated end portions, and a pair of said cutter blades are pivotally connected between said bifurcated end portions.

21. In a tool according to claim 17 wherein said pivotal mounting means includes ball joints in opposed facing relation to one another in said end portions, and said radially extending bores extend through said ball joints.

22. In a tool according to claim 17 wherein said body is of hollow generally cylindrical configuration having intermediate bifurcated mounting portions, and a pair of said cutter blades are pivotally connected between said bifurcated mounting portions.

23. In a tool according to claim 22 wherein said bifurcated mounting portions are disposed intermediately between opposite ends of said body, and said fluid delivery bore includes a bore section extending the substantial length of said body.

24. In a tool according to claim 23 wherein said body has opposed connecting ends and said fluid delivery bore extends between said opposite ends of said body.

* * * * *

UNITED STATES PATENT AND TRADEMARK OFFICE

CERTIFICATE OF CORRECTION

PATENT NO. : 6,959,774 B2
DATED : November 1, 2005
INVENTOR(S) : Nackerud , A. L.

It is certified that error appears in the above-identified patent and that said Letters Patent is hereby corrected as shown below:

Column 8,
Line 46, cancel “lover” and substitute -- lower --.

Column 9,
Line 24, cancel “passage” and substitute -- passages --.

Column 10,
Line 3, cancel “toot” and substitute -- tool --.

Signed and Sealed this

Twenty-seventh Day of December, 2005

JON W. DUDAS
*Director of the United States Patent and Trademark Office*